United States Patent [19]

Fentress

[11] 4,114,542

[45] Sep. 19, 1978

[54] PORTABLE, COLLAPSIBLE FURNITURE

[76] Inventor: D. G. Fentress, P.O. Box 6102, Clearwater, Fla. 33518

[21] Appl. No.: 800,396

[22] Filed: May 25, 1977

[51] Int. Cl.[2] ..... A47B 3/06

[52] U.S. Cl. ..... 108/157

[58] Field of Search ..... 108/118, 119, 132, 129, 108/159, 157; 248/432, 164; 297/159, 183, 56, 42, 17

[56] References Cited

U.S. PATENT DOCUMENTS

| | | | |
|---|---|---|---|
| 683,069 | 9/1901 | Pugh | 108/36 |
| 925,314 | 6/1909 | Durand | 108/41 |
| 1,072,060 | 9/1913 | Thompson | 108/150 |
| 1,089,289 | 3/1914 | Thompson | 108/150 |
| 1,325,164 | 12/1919 | Mowery | 108/34 |
| 1,963,594 | 6/1934 | Schwabe | 108/159 |
| 1,977,848 | 10/1934 | Gwynn | 108/157 |
| 2,180,525 | 11/1939 | Ingram | 108/36 |
| 2,675,286 | 4/1954 | Derman | 108/159 X |
| 2,676,709 | 4/1954 | Walsh | 248/432 X |
| 2,905,513 | 9/1959 | Kane | 108/128 |
| 3,120,405 | 2/1964 | Soszynski | 108/159 |
| 3,152,833 | 10/1964 | Creveling et al. | 297/140 |
| 3,404,915 | 10/1968 | Filho | 297/17 |
| 3,704,674 | 12/1972 | Johnson | 108/157 |

FOREIGN PATENT DOCUMENTS

| | | | |
|---|---|---|---|
| 948,646 | 1/1949 | France | 108/132 |

OTHER PUBLICATIONS

Furniture You Can Make (A Sunset Book), p. 75, "Fold-up table has three levels".

*Primary Examiner*—James T. McCall

*Attorney, Agent, or Firm*—Lowe, King, Price & Becker

[57] ABSTRACT

The disclosed invention is illustrated as a table, but it may also be embodied in a stool or a chair. It comprises an at least generally planar support surface, a legs subassembly comprising pivotably interlocked rectangular frames, means for releasably attaching the legs subassembly to the underside of the support surface with the rectangles pivoted to an open position to serve as supports, and means for releasably attaching the legs subassembly to the underside of the support surface with the rectangles pivoted to a closed position, generally parallel to the support surface. In the latter position, one side of the rectangles is positioned beyond the support surface and can function conveniently as a handle for carrying the device.

10 Claims, 7 Drawing Figures

PORTABLE, COLLAPSIBLE FURNITURE

BACKGROUND OF THE INVENTION

This invention relates to portable, collapsible furniture. Such furniture may be, for instance, a table, a stool, or a chair.

Various types of portable, collapsible furniture are of course known already.

One known type of portable, collapsible furniture employs a planar support surface and legs subassemblies comprising pivotably interlocked rectangular frames and means for releasably attaching the legs subassemblies to the support surface. So far as is known, however, such furniture either has no handle at all, requiring that it be maneuvered clumsily by means of grasping the body of the device, or has a separate handle, which performs no other function than that of a handle and in fact is in the way when the furniture is in use.

Another known type of portable, collapsible furniture, shown in U.S. Pat. No. 3,101,682 to Pugsley, employs a brace the links of which hold the legs against the underside of the table when the table is in its collapsed position and a portion of which extends beyond the support surface in that position to constitute a handle. However, that concept differs essentially from mine in that, in my device, the legs themselves form the handle and I have one complete leg assembly, not three separate pieces as in Pugsely.

SUMMARY OF THE INVENTION

My new portable, collapsible furniture is simple and more sturdy than the furniture shown in Pugsley and much more convenient to transport than the other furniture previously described. It comprises an at least generally planar support surface, a legs subassembly comprising pivotably interlocked rectangular frames, means for releasably attaching the legs subassembly to the underside of the support surface with the rectangles pivoted to an open position to serve as supports, and means for releasably attaching the legs subassembly to the underside of the support surface with the rectangles pivoted to a closed position, generally parallel to the support surface. In the latter position, one side of the rectangles is positioned beyond the support surface and can function conveniently as a handle for carrying the device.

The advantages of the present invention will become apparent to those skilled in this art from the following detailed description, wherein I have described only the preferred embodiments of the invention, simply by way of illustration of the best modes contemplated by me of carrying out my invention. As will be realized, the invention is capable of other and different embodiments, and its several details are capable of modification in various obvious respects, all without departing from the invention. Accordingly, the drawings and description are to be regarded as illustrative in nature, and not as restrictive.

DETAILED DESCRIPTION OF THE PRESENTLY PREFERRED EMBODIMENTS

Figure 1:
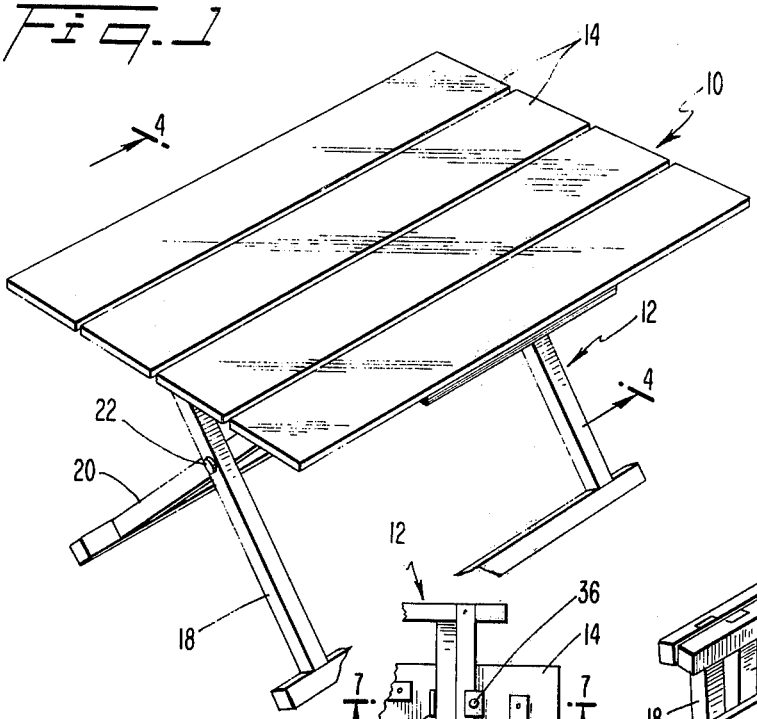
FIG. 1 is an overall perspective view of a table embodying the subject invention in its opened position.
Figure 7:
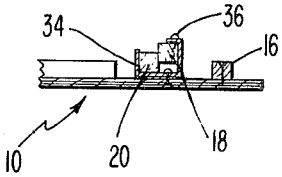
FIG. 7 is a partial cross section along the line 7—7 in FIG. 6.
Figure 6:
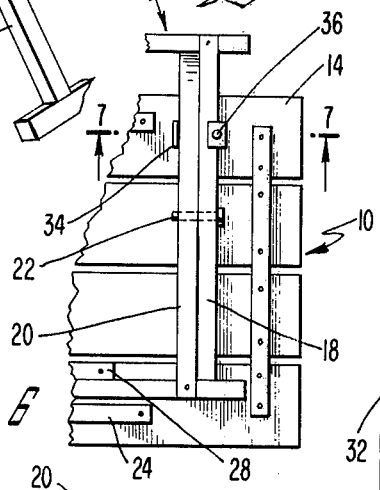
FIG. 6 is a detail of a second embodiment of the subject invention.

The subject invention comprises an at least generally planar support surface 10, a legs subassembly 12, and means for releasably attaching the legs subassembly 12 to the support surface 10 when the former is in both its opened and collapsed position. In the embodiments of FIGS. 1–5, the support surface 10 comprises a plurality of slats 14 held in parallel by spaced braces 16 mounted on the underside of the support surface 10. In the embodiment of FIGS. 6 and 7, the support surface 10 comprises a single, integral piece, which may, for instance, be molded from plastic. It should also be noted that, while the illustrated embodiments are both tables and the support surface 10 is accordingly flat, the invention also extends to stools, chairs, and the like in which the support surface 10 would ordinarily not be flat.

Figure 3:
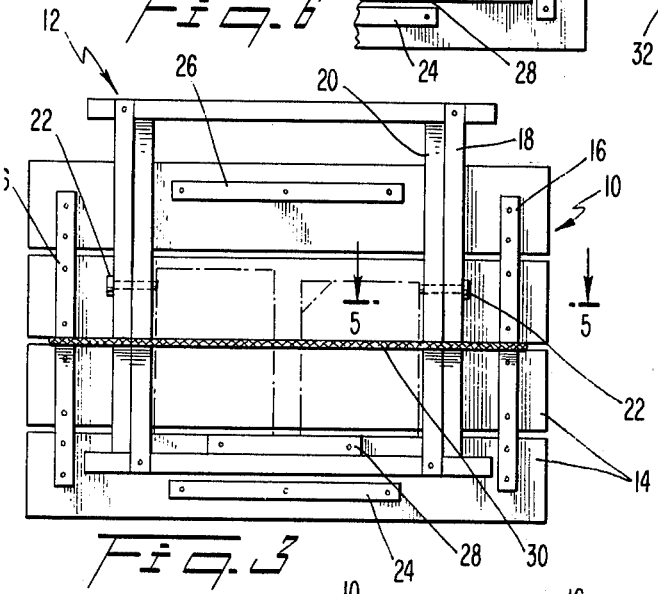
FIG. 3 is a bottom view of the table shown in FIG. 1 in its collapsed position.
Figure 4:
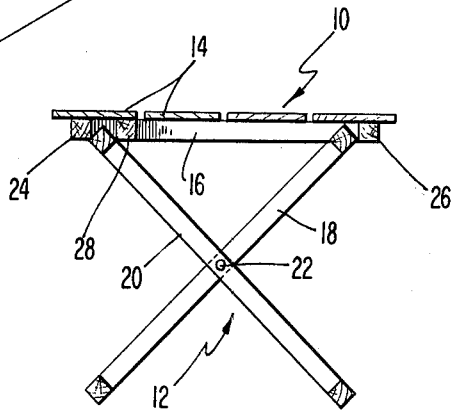
FIG. 4 is a cross section along the lines 4—4 in FIG. 1.
Figure 5:
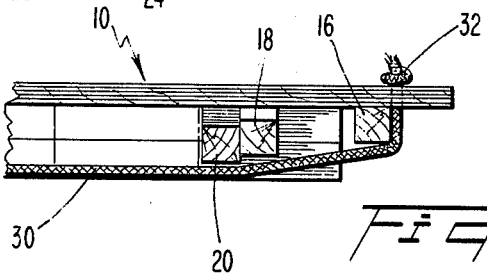
FIG. 5 is a partial cross section along the lines 5—5 in FIG. 3.

The legs subassembly comprises a first leg member 18 and a second leg member 20, each of which is formed from four struts joined together in the shape of a rectangle. (The word "rectangle" is, of course, intended to comprehend a square as a special case thereof.) The lengths of the leg members 18 and 20 are at least approximately equal (they would ordinarily be exactly equal in a table, as shown), and the width of the leg member 20 is such that it fits inside the leg member 18, as best seen in FIGS. 3 and 6. The leg members 18 and 20 are pivotably joined at 22 for pivotal movement about axes through their sides intermediate their ends. Thus, the legs subassembly 12 can be pivoted back and forth between a collapsed position in which the tops and bottoms of the leg members 18 and 20 are in contact (as best seen in FIG. 2) and an opened position in which, as illustrated in FIG. 4, the leg members form an X in side view.

Means are provided on the underside of the support surface 10 for releasably attaching the legs subassembly 12 when in its opened position to the support surface 10 such that the tops of the leg members 18 and 20 carry the support surface 10 and the leg subassembly 12 serves as legs for the support surface. Preferably these means comprise two spaced shoulders or braces 24 and 26 mounted on the underside of the support surface 10 in position to hold the leg members 18 and 20 against further opening, as best seen in FIG. 4.

Figure 2:
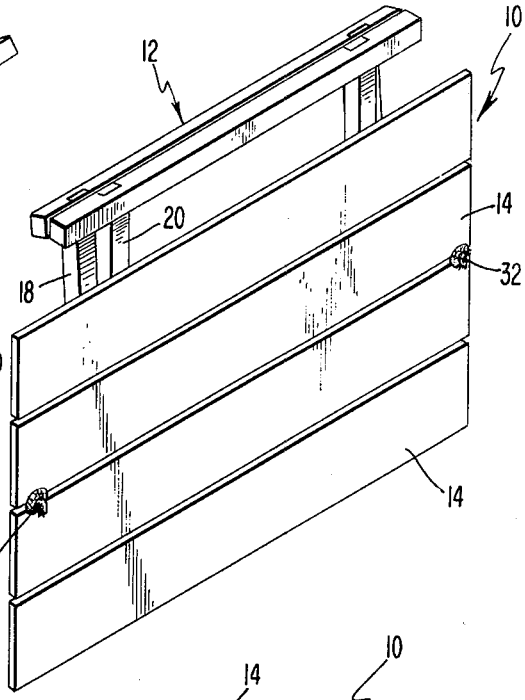
FIG. 2 is an overall perspective view of the table shown in FIG. 1 in its collapsed position.

Means are also provided on the underside of the support surface 10 for releasably attaching the legs subassembly 12 when in its collapsed position to the support surface 10 such that the leg members 18 and 20 are generally parallel to the support surface 12 and one side of the leg member 18 and 20 is positioned beyond the support surface 10, as best seen in FIG. 2. In this position, the side of the leg members extending beyond the support surface 10 can function conveniently as a handle for carrying the device. As best seen in FIG. 3, these means can comprise three different, cooperating subassemblies.

The first of these subassemblies comprises a pair of shoulders or braces 24, 28 mounted on the underside of the support surface 10 and spaced by a distance just greater than the height of the struts which made up one side of at least one of the leg members 18 and 20. As shown, the shoulder 24 which is one of this pair of shoulders is preferably the same shoulder 24 which is one of the previously mentioned pairs of shoulders 24, 26. In any event, whether it is the same shoulder or a separate shoulder, one side of at least one of the leg members 18, 20 can be placed between the adjacent faces of the shoulders 24, 28 and held against movement perpendicular to those shoulders.

The second of these subassemblies comprises a second pair of shoulders, perpendicular to the first pair of shoulders. The second pair of shoulders can conveniently be the previously mentioned mounting braces 16. In any event, the second pair of shoulders is mounted on the underside of the support surface 10 and spaced by a distance just greater than the width of the leg member 18, so that the legs subassembly 12 can be placed between the adjacent faces of the second pair of shoulders and held against movement perpendicular to those shoulders.

The third of these three subassemblies comprises a flexible, elastic member 30, which may conveniently be a shock cord; and means such as an enlargement or knot 32 at either end of the member 30 for releasably connecting the member 20 at either end to the support surface 10 in position to pass over the legs subassembly 12. As shown in FIG. 3, the member 30 can also be used to hold miscellaneous articles to the underside of the support surface 10 for carrying purposes.

As shown in FIGS. 6 and 7, the means for releasably attaching the legs subassembly to the support surface 10 when the former is in its collapsed position can also comprise two subassemblies, one of which is the same as the first of the three subassemblies previously described. The other, however, is totally different from the second and third subassemblies previously described, although it has the same function. As best seen in FIG. 7, it comprises at least one (more than one may be provided to increase the strength of the device) pair of retaining jaws 34 mounted on the underside of the support surface 10 and sized and positioned to releasably graps adjacent struts in the leg members 18 and 20 and to hold them against movement perpendicular to the jaws in the plane of the support surface 10 and against movement perpendicular to that plane. At least one of the pair of retaining jaws 34 is preferably made out of a resilient material, such as spring steel or a resilient plastic, allowing that pair to be bent out of place and the adjacent struts to be placed against the other jaw. After the struts are in place, the resilient jaw is allow to move back into place to grasp the adjacent struts securely. As shown, a knob 36 is preferably provided on top of the resilient jaw to facilitate this operation.

What is claimed is:

1. A portable, collapsible piece of furniture, said furniture comprising:

(a) an at least generally planar support surface;

(b) a legs subassembly;

($b_1$) said support surface comprising at least two pairs of spaced braces mounted on the underside of said support surface, said pairs of braces being substantially perpendicular to each other and also serving as stops limiting the movement of said legs subassembly in both its opened and collapsed positions, said legs subassembly lying substantially between said pairs of braces and parallel thereto in said collapsed position;

(c) means for releasably attaching said legs subassembly when in its opened position to said support surface; and (d) means for releasably attaching said legs subassembly when in its collapsed position to said support surface such that said subassembly can function conveniently as a handle for carrying said piece of furniture.

2. A piece of furniture as recited in claim 1 wherein said support surface comprises a single, integral piece.

3. A piece of furniture as recited in claim 2 wherein said support surface is molded from plastic.

4. A piece of furniture as recited in claim 1 wherein said legs subassembly comprises;

a first leg member formed from four struts joined together in the shape of a rectangle;

a second leg member formed from four struts joined together in the shape of a rectangle, the lengths of said first and second leg member being at least approximately equal and the width of said second leg member being such that it fits inside said first leg member; and means for pivotably joining said first and second leg members at pivot axes through their sides intermediate their ends, whereby said legs subassembly can be pivoted back and forth between a collapsed position in which the tops and bottoms of said first and second leg members are in contact and an opened position in which said first and second leg members for an X in side view;

the tops of said first and second leg members carrying said support surface, in which position said legs subassembly serves as legs for said support surface;

said subassembly and second leg members being generally parallel to said support surface and one side of said first and second leg members being positioned beyond said support surface, in which position said one side of said first and second members forms said handle;

said means for releasably attaching said legs subassembly when in its opened position to said support surface comprising the adjacent faces of one pair of said spaced braces mounted on the underside of said support surface, whereby said legs subassembly is held against further opening by said braces.

5. A piece of furniture as recited in claim 4 wherein said means for releasably attaching said legs subassembly when in its collapsed position to said support surface comprise the adjacent faces of a first pair of braces mounted on the underside of said support surface and spaced by a distance just greater than the height of the struts which make up one side of at least one of said leg members, whereby said one side of at least one of said leg members can be placed between said first pair of braces and held against movement perpendicular to said first pair of braces by said braces.

6. A piece of furniture as recited in claim 5 wherein said means for releasably attaching said legs subassembly when in its collapsed position to said support surface further comprises the adjacent faces of a second pair of braces mounted on the underside of said support surface, perpendicular to said first pair of braces, and spaced by a distance just greater than the width of said first leg member, whereby said legs subassembly can be placed between said second pair of braces and held against movement perpendicular to said second pair of braces by said brace.

7. A piece of furniture as recited in claim 6 wherein said means for releasably attaching said legs subassembly when in its collapsed position to said support surface further comprises a flexible, elastic member and means for releasably connecting it at either end to said support surface in position to pass over said legs subassembly.

8. A piece of furniture as recited in claim 1 wherein said means for releasably attaching said legs subassembly when in its collapsed position to said support surface comprises a flexible, elastic member and means for releasably connecting it at either end to said support surface in position to pass over said legs subassembly.

9. A piece of furniture as recited in claim 4 wherein said means for releasably attaching said legs subassembly when in its collasped position to said support surface comprise:

(a) a pair of braces mounted on the underside of said support surface and spaced by a distance just greater than the height of the struts which make up one side of at least one of said leg members, whereby said one side of at least one of said leg members can be placed between said braces and held against movement perpendicular to said braces by said braces, and (b) at least one pair of retaining jaws mounted on the underside of said support surface, said at least one pair of retaining jaws being sized and positioned to releasably grasp adjacent struts in said first and second leg members and to hold them against movement perpendicular to said jaws in the plane of said support surface and against movement perpendicular to said support surface.

10. A piece of furniture as recited in claim 9 wherein at least one jaw of said pair of retaining jaws is made out of a resilient material, whereby that jaw can be bent out of place, said adjacent struts can be placed in position against the other jaw, and the resilient jaw can then be allowed to move back into place to grasp said adjacent struts.

* * * * *